US005525751A

United States Patent [19]

Niederkorn

[11] Patent Number: 5,525,751

[45] Date of Patent: Jun. 11, 1996

[54] SYSTEM FOR MOVING A SUBMERGED WEB

[75] Inventor: Reed J. Niederkorn, St. Louis, Mo.

[73] Assignee: Monsanto Company, St. Louis, Mo.

[21] Appl. No.: 128,394

[22] Filed: Sep. 28, 1993

[51] Int. Cl.[6] ..... B05C 3/12

[52] U.S. Cl. ..... 118/423; 118/419; 68/158

[58] Field of Search ..... 226/97, 188; 118/263, 118/211, 216, 218, 423, 264, 419, 258; 492/30, 15; 68/158

[56] References Cited

U.S. PATENT DOCUMENTS

| | | | |
|---|---|---|---|
| 2,883,475 | 4/1959 | Rider et al. | 226/97 |
| 3,186,326 | 6/1965 | Schmidt | 226/97 |
| 3,394,041 | 7/1968 | De Ligt | 226/97 |
| 4,288,015 | 9/1981 | Curtin | 266/97 |
| 4,399,954 | 8/1983 | Arrant | 242/86.52 |
| 4,518,466 | 5/1985 | Takahashi et al. | 204/28 |
| 4,785,986 | 11/1988 | Daane et al. | 226/97 |

FOREIGN PATENT DOCUMENTS

| | | |
|---|---|---|
| 931182 | 2/1948 | France . |
| 922302 | 3/1963 | United Kingdom . |
| 1040342 | 1/1964 | United Kingdom . |
| 1033599 | 9/1965 | United Kingdom . |

*Primary Examiner*—Brenda A. Lamb
*Attorney, Agent, or Firm*—Thomas E. Kelley

[57] ABSTRACT

Apparatus for moving a submerged web through a liquid, comprising a cylindrical tube with ends adapted to prevent fluid flow out of said ends and/or with a peripheral area containing a plurality of uniformly sized and spaced apertures. A liquid pump, e.g. a venturi, supplies a flow of liquid into the tube allowing a moving web to be carried on a liquid bearing over a part of the aperture-containing peripheral area. The tube can be rotated, e.g. by a fluid jet, to assist in conveying a porous web being treated with the fluid providing web floatation off the tube.

10 Claims, 1 Drawing Sheet

SYSTEM FOR MOVING A SUBMERGED WEB

Disclosed herein are systems for moving submerged webs, e.g. porous webs submerged in liquid baths, and methods for using such systems for conveying and treating webs in liquids.

BACKGROUND OF THE INVENTION

It is known to use stationary surfaces which are perforated for supporting a sheet passing over the surface. A fluid is passed through the perforations to lift the sheet off the surface as it is being advanced to thereby eliminate a frictional contact with the surface. While this structure is useful in reducing frictional contact with guide surfaces, it offers nothing in the way of helping to advance the sheet or web along its path.

If a very long web is being advanced through a bath by a pulling force the web may be damaged by the tensile forces used to move the web through the bath. Also, some webs to be treated in a bath are very delicate, such that a tensile force applied at the end of the web to pull it through a bath will almost certainly damage the web. Thus, it would be desirable to have structure in the bath which would offer a frictionless support of the web and at the same time assist in moving the web through the bath. This is what applicant's structure achieves.

SUMMARY OF THE INVENTION

This invention provides apparatus for supporting and advancing a submerged web through a liquid bath comprising a cylindrical tube rotatably supported at the ends thereof and adapted to be connected to a source of pressurized liquid. The tube has an apertured peripheral area and/or one or more tangential nozzles and is adapted to carrying a web on over the tube at reduced frictional contact with the roller supporting the web.

DETAILED DESCRIPTION OF THE INVENTION

Figure 1:
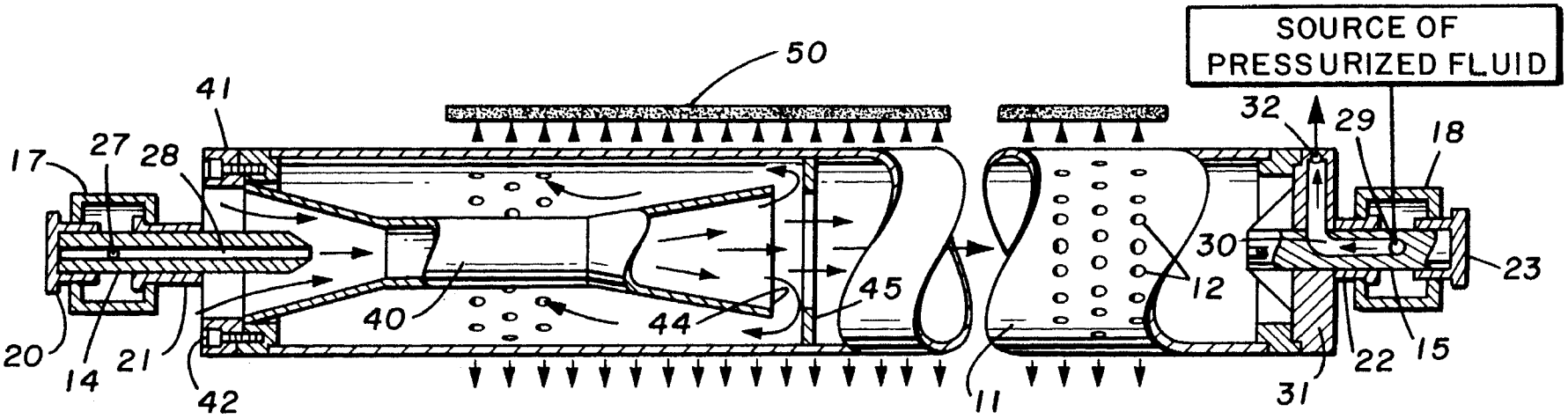
FIG. 1 is an enlarged cross sectional view of one embodiment of the apparatus of this invention showing the relationship of the various elements making up the invention.

The apparatus of this invention for moving a submerged web through a liquid comprises a cylindrical tube rotatably supported at the ends thereof and adapted to be connected to a source of pressurized liquid. Such cylindrical tubes have at least one of:

(a) a peripheral area containing a plurality of apertures adapted to allow pressurized liquid to flow out of the tube and ends adapted to restrict the flow of pressurized liquid out of said tube to allow a moving web to be carried on a liquid bearing over a part of the aperture-containing peripheral area; or (b) a tangential nozzle adapted to rotating the tube by the expulsion of said pressurized fluid. In preferred embodiments certain tubes have both an apertured peripheral area and at least on tangential nozzle. The tube preferably rotatably supported on journals positioned along the axis of said tube at opposite ends thereof. A convenient source of pressurized liquid is a pump that supplies bath fluid to the tube at an elevated pressure. For instance, liquid can be conveniently pumped to a venturi through a bore in the journal proximate to said venturi. Moreover, the source of pressurized liquid can preferably comprise a venturi mounted in one end of said tube and with the inlet end of the venturi submerged in the bath liquid. When a small volume of pressurized liquid is pumped through said venturi a large volume is liquid is educted through said venturi to the center of the tube. When a web is being carried on a bearing surface of fluid being expelled from apertures in the circumference of the tube, variations in volume across the length of the tube can effect the relative stability of the web tracking on such rollers. For instance, high volume flow creating a thicker fluid bearing at one end of a tube can tend to drive a web to the other end of the tube. In some cases it may be desirable to arrange tubes in alternate patterns so that web drift tendencies are cancelled. In other cases it may be preferred to provide a tube with at least one internal circumferential baffle to promote equal fluid pressure within the tube. In other cases it may be desirable to use a venturi at both ends of said tube. This can create a high pressure, high volume environment in the center of the tube, effecting a crowned fluid bearing which tends to keep a web centered on the tube. The periphery of a tube can be provided with uniformly sized and spaced apertures or with apertures with a gradient pattern of hole size and distribution.

A tube can be rotated by a variety of drive mechanisms. A preferred drive mechanism for rotating a tube is a tangential nozzle connected to a source of pressurized fluid, e.g. through tubular passages originating in a hollow journal. In some cases tangential nozzles can be located at both ends of a tube. In a preferred aspect of this invention, one end of a tube has a tangential drive nozzle and the other end of the tube has a venturi for supplying pressurized fluid to promote a frictionless bearing of a web over the perforated tube.

This invention also provides methods for treating porous webs with a liquid, e.g. in washing, coating and plating operations, with rotating cylindrical boundary layers submerged in a liquid bath. An advantage of this method is to employ a cylindrical boundary layer rotating about a horizontal axis to assist in moving a web through the bath, e.g. keeping the web tangent to the boundary layer. That is, the liquid flowing from apertures provides a bearing for low friction web conveyance. Another advantage in the fluid treatment of webs is that the apparatus of this invention allows liquid to be forced radially outward through the boundary layer into contact with the web. In the case of porous webs the fluid can advantageously engage and permeate the web in a zone maintained in tangential contact with the cylindrical boundary layer. Fluid penetration of porous webs by radially moving liquid from the apertures facilitates washing, coating and plating operations. The apparatus and methods of this invention are especially useful in the uniform electroless plating of fabrics.

Referring now to FIG. 1 there is shown in more detail aspects of embodiments of this invention. Cylindrical tube 11 having a plurality of spaced apertures 12 extending radially through the peripheral surface of the tube. The tube is supported at its ends by shafts 14 and 15 which are mounted in journal boxes 17 and 18 by means of bearings 20, 21, 22 and 23. Each journal box is provided with a pressurized liquid connection not shown. In operation bath fluid is pumped to journal boxes to rotate the tube or provide fluid bearing through apertures 12 to provide frictionless transport of submerged web being moved through a liquid bath.

Tube rotation can be effected by the pumping fluid through shaft 15 which is provided with an inlet 29 leading from fluid pressurized journal box 18 to an axial passageway 30 extending through shaft 15 and tube head 31 terminating in a tangential port 32 in the head providing a tangential nozzle in the periphery of the tube. The angle of the tangential port allows pressurized liquid flowing from the port to rotate the tube.

Frictionless conveyance of a submerged web over the tube is effected by forcing pressurized bath fluid through apertures 12. Shaft 14 is provided with an inlet opening 27 leading from the fluid pressurized interior of journal box 17 to an axial passageway 28 leading through shaft 14. A venturi tube 40 is provided with an inlet flange 41 allowing attachment to one end of the tube with bolts 42. Pressurized liquid flowing from journal box 17 through bore 27 in shaft 14 acts as a motive fluid educting large volumes bath fluid into the bore of the tube. The operation of the venturi causes the fluid in the bore of the tube to be at a higher pressure that the fluid outside of the tube, causing flow through apertures 12 which can lift a web 50 and keep it spaced from the surface of the tube 11. Venturi design, e.g. fluid pressure and flow rates, will depend on the porosity of the web to be conveyed. For instance, solid film webs will require less bearing fluid volume than porous fabrics.

To provide uniform web travel over a tube, e.g. without skewing or wrinkling, modifications of the apparatus of this invention can be implemented with routine experimentation. For instance, in some cases it is advantageous to provide an orifice wall 45 positioned in the bore of the tube, perpendicular to the axis of the tube and spaced from the outlet end 44 of the venturi, to balance fluid pressure within the tube.

In other cases it is useful to provide a venturi at both ends of a tube, resulting in a pressure profile within the tube with higher fluid pressure in the center and lower pressure at the ends. This causes the fluid bearing outside of the tube to be higher in the center causing to tube to operate like a crown roller, i.e. tending to keep a web tracking in the center of the tube. With venturi on both sides of one or more tubes in a series, it is sometimes advantageous to employ a drive tube having tangential ports on both sides of the tube to provide friction contact for diving a web.

Figure 2:
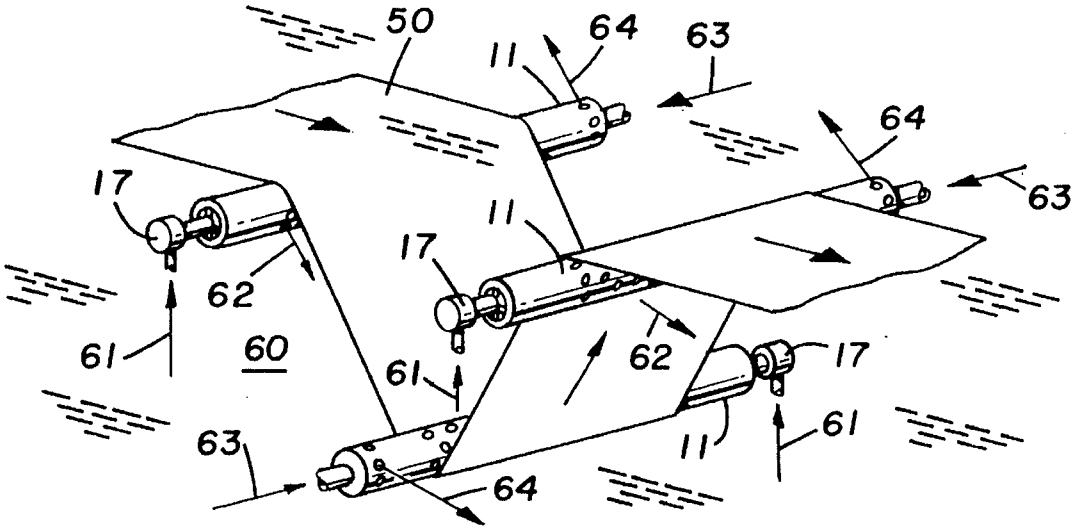
FIG. 2 is a perspective view showing the manner in which several of the devices of this invention can be used to support and advance a web through a bath.

In other cases when webs tend to drift away from a high pressures side of a tube, it is useful to alternate the orientation of tubes as shown in FIG. 2 where web 50 submerged in bath 60 is carried over a series of tubes 11. Journal box 17 is located on alternating sides of the tubes. Pressurized fluid 61 enters journal boxes 17 and exits the apertures in a flow 62 providing a bearing surface for the web. On alternate side of the tubes pressurized fluid 63 flows through tangential ports in a stream 64 which provides motive force for tube rotation.

While specific embodiments have been described herein, it should be apparent to those skilled in the art that various modifications thereof can be made without departing from the true spirit and scope of the invention. Accordingly, it is intended that the following claims cover all such modifications within the full inventive concept.

What is claimed is:

1. Apparatus for moving a submerged web through a liquid comprising a cylindrical tube rotatably supported at the ends thereof and adapted to be connected to a source of pressurized liquid, wherein said tube has:

(a) a peripheral surface area containing a plurality of apertures adapted to allow said pressurized liquid to flow out of said tube, wherein the ends are adapted to restrict the flow of pressurized liquid out of said tube so as to allow a moving web to be carried on a liquid bearing over a part of the aperture-containing peripheral area; and (b) at least one tangential nozzle arranged in at least one of ends of said tube and at the periphery of said tube adapted to rotating said tube by expulsion of said pressurized liquid.

2. Apparatus according to claim 1 wherein said tube has journals positioned along the axis of said tube at the ends thereof to rotatably support said tube.

3. Apparatus for moving a submerged web through a liquid comprising a cylindrical tube rotatably supported at the ends thereof and adapted to be connected to a source of pressurized liquid, wherein said tube has (a) a peripheral area containing a plurality of apertures adapted to allow said pressurized liquid to flow out of said tube wherein the ends are adapted to restrict the flow of pressurized liquid out of said tube so as to allow a moving web to be carried on a liquid bearing over a part of the aperture-containing peripheral area;

(b) at least one tangential nozzle arranged in at least one of the ends of said tube and at the periphery of said tube adapted to rotating said tube by expulsion of said pressurized liquid; and (c) journals positioned along the axis of said tube at the ends thereof to rotatably support said tube;

wherein said source of pressurized liquid comprises a venturi mounted in one end of said tube and with an inlet end of said venturi submerged in said pressurized liquid and wherein when a small volume of said pressurized liquid is pumped through said venturi a large volume of said pumped liquid is educted through said venturi to he center of said tube.

4. Apparatus according to claim 3 wherein said tube has at least one internal circumferential baffle adapted to promote equal fluid pressure within said tube.

5. Apparatus according to claim 3 wherein said plurality of aperture are uniformly sized and spaced and extend around the periphery of said tube.

6. Apparatus according to claim 3 wherein said pressurized liquid is pumped to said venturi through a bore in the journal proximate to said venturi.

7. Apparatus according to claim 3 wherein at least one journal has a fluid passage for connecting said source of pressurized liquid to said at least one tangential nozzle adapted to rotating said tube.

8. Apparatus for moving a submerged web through a liquid comprising a cylindrical tube rotatably supported at the ends thereof and adapted to be connected to a source of pressurized liquid, wherein said tube has (a) a peripheral area containing a plurality of apertures adapted to allow said pressurized liquid to flow out of said tube, wherein the ends are adapted to restrict the flow of pressurized liquid out of said tube so as to allow a moving web to be carried on a liquid bearing over a part of the aperture-containing peripheral area;

(b) at least one tangential nozzle arranged in at least one of the ends of said tube and at the periphery of said tube adapted to rotating said tube by expulsion of said pressurized liquid; and (c) journals positioned along the axis of said tube at the ends thereof to rotatably support said tube;

wherein at least one of said journals has a fluid passage for connecting said source of pressurized liquid to said tangential nozzle.

9. Apparatus for moving a submerged web through a liquid comprising a cylindrical tube rotatably supported at the ends thereof and adapted to be connected to a source of pressurized liquid, wherein said tube has (a) a peripheral area containing a plurality of apertures adapted to allow said pressurized liquid to flow out of said tube, wherein the ends are adapted to restrict the flow of pressurized liquid out of said tube so as to allow a moving web to be carried on a liquid bearing over a part of the aperture-containing peripheral area;

(b) a venturi at one end of said tube for supplying said pressurized liquid for carrying said web;

(c) at least one tangential nozzle at the periphery of the other end of said tube adapted to rotating said tube by expulsion of pressurized liquid; and (d) journals positioned along the axis of said tube at the ends thereof to rotatably support said tube.

10. Apparatus according to claim 9 wherein said tube has at least one internal circumferential baffle adapted to promote equal fluid pressure within said tube.

* * * * *